US008736530B2

(12) United States Patent
Guo

(10) Patent No.: US 8,736,530 B2
(45) Date of Patent: May 27, 2014

(54) METHOD FOR DRIVING LIQUID CRYSTAL DISPLAY

(75) Inventor: Dong-sheng Guo, Guangdong (CN)

(73) Assignee: Shenzhen China Star Optoelectronics Technology Co., Ltd., Shenzhen (CN)

( * ) Notice: Subject to any disclaimer, the term of this patent is extended or adjusted under 35 U.S.C. 154(b) by 0 days.

(21) Appl. No.: 13/145,003

(22) PCT Filed: May 11, 2011

(86) PCT No.: PCT/CN2011/073959

§ 371 (c)(1),
(2), (4) Date: Jul. 18, 2011

(87) PCT Pub. No.: WO2012/145942

PCT Pub. Date: Nov. 1, 2012

(65) Prior Publication Data

US 2014/0035958 A1 Feb. 6, 2014

(30) Foreign Application Priority Data

Apr. 27, 2011 (CN) ..... 2011 1 0106562

(51) Int. Cl.
*G09G 3/36* (2006.01)

(52) U.S. Cl.
USPC ..... 345/94; 345/89; 345/90; 345/95; 345/208; 345/210

(58) Field of Classification Search
USPC ..... 345/87–104, 208–210; 349/33–34
See application file for complete search history.

(56) References Cited

U.S. PATENT DOCUMENTS

| | | | | |
|---|---|---|---|---|
| 6,710,759 | B1 * | 3/2004 | Kondoh | 345/92 |
| 6,914,589 | B2 * | 7/2005 | Choi | 345/96 |
| 7,173,591 | B2 * | 2/2007 | Monomohshi | 345/96 |
| 7,218,303 | B2 * | 5/2007 | Kim | 345/97 |
| 8,373,729 | B2 * | 2/2013 | Lee et al. | 345/690 |
| 8,421,945 | B2 * | 4/2013 | Lee | 349/54 |
| 2003/0071773 | A1 | 4/2003 | Ohtani et al. | |
| 2006/0176260 | A1 | 8/2006 | Koyama | |

(Continued)

FOREIGN PATENT DOCUMENTS

| | | | |
|---|---|---|---|
| CN | 1412738 | A | 4/2003 |
| CN | 1497527 | A | 5/2004 |

(Continued)

*Primary Examiner* — Alexander Eisen
*Assistant Examiner* — Sanjiv D Patel
(74) *Attorney, Agent, or Firm* — Mark M. Friedman

(57) ABSTRACT

A method for driving a liquid crystal display (LCD) is disclosed. The LCD includes a common electrode, a pixel electrode, and a liquid crystal layer having a plurality of impurity ions. The method includes: separating the impurity ions toward the common electrode and the pixel electrode to form an internal electric field in the liquid crystal layer; and providing a common voltage for the common electrode, and providing a first compensation voltage and a second compensation voltage for the pixel electrode. The first compensation voltage and the second compensation voltage herein are utilized to compensate the internal electric field so that a difference between the first compensation voltage and the common voltage is equal to a difference between the second compensation voltage and the common voltage. Charge accumulation is formed intentionally, and then the first compensation voltage and the second compensation voltage are provided to correctly display images.

14 Claims, 8 Drawing Sheets

(56) References Cited

U.S. PATENT DOCUMENTS

| | | | | |
|---|---|---|---|---|
| 2007/0024560 | A1* | 2/2007 | Kim et al. | 345/94 |
| 2008/0111767 | A1* | 5/2008 | Liu et al. | 345/58 |
| 2008/0309837 | A1 | 12/2008 | Abe | |
| 2010/0033413 | A1 | 2/2010 | Song et al. | |
| 2010/0231814 | A1 | 9/2010 | Yamada et al. | |
| 2012/0133869 | A1* | 5/2012 | Liao et al. | 349/106 |

FOREIGN PATENT DOCUMENTS

| | | | |
|---|---|---|---|
| CN | 101512627 | A | 8/2009 |
| CN | 101645244 | A | 2/2010 |
| CN | 101656051 | A | 2/2010 |
| EP | 2003637 | A2 | 12/2008 |
| JP | 2010113148 | A | 5/2010 |

* cited by examiner

METHOD FOR DRIVING LIQUID CRYSTAL DISPLAY

FIELD OF THE INVENTION

The present invention relates to a driving method, and especially to a method for driving a liquid crystal display (LCD).

BACKGROUND OF THE INVENTION

Referring to FIG. 1, FIG. 1 is a schematic cross-sectional view illustrating a conventional liquid crystal display. At present, an AC voltage is used to drive an LCD, therefore there are two electrodes respectively disposed on both sides of a liquid crystal layer, one being a common electrode 100 and another being a pixel electrode 200. There exist positive or negative impurity ions 10 in the liquid crystals.

Referring to FIG. 2, FIG. 2 is a schematic drawing illustrating a waveform of conventional AC driving voltages. During a fixed image, two different pixel voltages Vp1 and Vp2 are provided for the pixel electrode 200 in different frames, this enables the common electrode 100 (the voltage thereof is a VCOM) and the pixel electrode 200 to form electric fields with opposite directions and identical voltage differences, thereby driving the LCD in the AC voltages. Referring to FIGS. 3 and 4, FIG. 3 is a schematic drawing illustrating the impurity ions moving when Vp1 is added; and FIG. 4 is a schematic drawing illustrating the impurity ions moving when Vp2 is added. When adding the voltage Vp1, that is, Vp1<VCOM, the distances which the positive or negative impurity ions 10 move are labeled d. When adding the voltage Vp2, that is, Vp2>VCOM, the opposite direction which the positive or negative impurity ions 10 move are also labeled d. Therefore, the impurity ions 10 are not gathered collectively.

In general, the voltage of the common electrode 100 is fixed. However, in order to achieve the image quality improvements or implement other driving architectures, the voltage of the common electrode is set to be changeable. Either way, the absolute values of the voltage differences between two ends of the electrodes are as equal as possible. Referring to FIGS. 5 and 6, FIG. 5 is a schematic drawing illustrating a waveform of the driving voltages with two unequal voltage differences; and FIG. 6 is a schematic drawing illustrating the moving impurity ions when adding the voltages shown in FIG. 5. While the absolute value of the difference between Vp1 and VCOM is unequal to the absolute value of the difference between Vp2 and VCOM, the moving distances d1 and d2 of the positive or negative impurity ions are not the same. This will result in charge residuals, that is, the impurity ions within the liquid crystal layer will gather collectively on both sides, as shown in FIG. 6.

When more of positive and negative impurity ions 10 are attached to the common electrode 100 and an alignment film (not shown) of the pixel electrode 200, an internal voltage Vi can be formed. Accordingly, when Vp1 and Vp2, which correspond to a certain gray scale, are provided, the differences between Vp1 and Vp2 in relations to VCOM are affected by Vi, and then tilted angles of the liquid crystal molecules are changed. Thus, flicker and color deviation may occur on the images. Moreover, the attached impurity ions will always be attached to the alignment film and cannot be restored. So the above-mentioned non-recoverable and non-maintenance occurrence is referred to as a liquid crystal polarization problem.

Therefore, in order to ensure that the liquid crystals are not polarized, there is a need for a stable common electrode voltage to form the same absolute values of the differences between the common electrode voltage and the pixel voltage. However, as for the whole display panel, it is difficult to make the voltage on every common electrode to be same. At present, all the conventional techniques intend to solve the above-mentioned problem is by reducing the charge residuals, but the problem still occurs after a long operation time.

SUMMARY OF THE INVENTION

An objective of the present invention is to provide a method for driving an LCD, to solve the above-mentioned issues of the charge residuals by means of intentionally by design to form the charge residuals and then adjust a driving voltage.

To achieve the foregoing objective, according to an aspect of the present invention, a method for driving a liquid crystal display (LCD), the LCD includes a common electrode, a pixel electrode, a liquid crystal layer which is located between the common electrode and the pixel electrode, and the liquid crystal layer having a plurality of impurity ions, also a pixel utilized to display a gray scale. The driving method includes: separating the impurity ions toward the common electrode and the pixel electrode for forming an internal electric field in the liquid crystal layer; and providing a common voltage for the common electrode, and providing a first compensation voltage and a second compensation voltage for the pixel electrode according to the gray scale. The first compensation voltage and the second compensation voltage herein are utilized to compensate the internal electric field so that a difference between the first compensation voltage and the common voltage is equal to a difference between the second compensation voltage and the common voltage.

Preferably, the step which is to separate the impurity ions is done by providing an offset common voltage at the common electrode, and providing a first voltage and a second voltage at the pixel electrode so that a difference between the first voltage and the offset common voltage is unequal to a difference between the second voltage and the offset common voltage. Specifically, the second voltage is larger than the first voltage, and the offset common voltage is between the first voltage and the second voltage.

Preferably, the difference between the offset common voltage and the first voltage is larger than the difference between the offset common voltage and the second voltage. A direction of the internal electric field is toward the common electrode from the pixel electrode. In addition, the first compensation voltage is a first pixel voltage minus a voltage value of the internal electric field, and the second compensation voltage is a second pixel voltage minus a voltage value of the internal electric field.

Preferably, the difference between the offset common voltage and the first voltage is less than the difference between the offset common voltage and the second voltage. A direction of the internal electric field is toward the pixel electrode from the common electrode. In addition, the first compensation voltage is a first pixel voltage plus a voltage value of the internal electric field, and the second compensation voltage is a second pixel voltage plus a voltage value of the internal electric field.

It is worth mentioning that the first compensation voltage and second compensation voltage are adjusted by using resistors or a digital-to-analog converter integrated circuit.

Compared with the prior art, the present invention solves the above-mentioned issue from a reverse notion. That is, the charge accumulation is intentionally formed, and then the first compensation voltage and the second compensation voltage are provided, thereby correctly displaying the images.

Accordingly, the impact of the charge residuals on the images is eliminated on one hand; on the other hand, even if there are some deviations on the voltage differences between the common electrode and the pixel electrode, there will be no impact caused by the accumulation of the moving impurity ions, resulting in an abnormal image display.

It is to be understood that both the foregoing general description and the following detailed description of the present invention are exemplary and explanatory and are intended to provide further explanation of the invention as claimed:

DETAILED DESCRIPTION OF THE PREFERRED EMBODIMENTS

Figure 1:
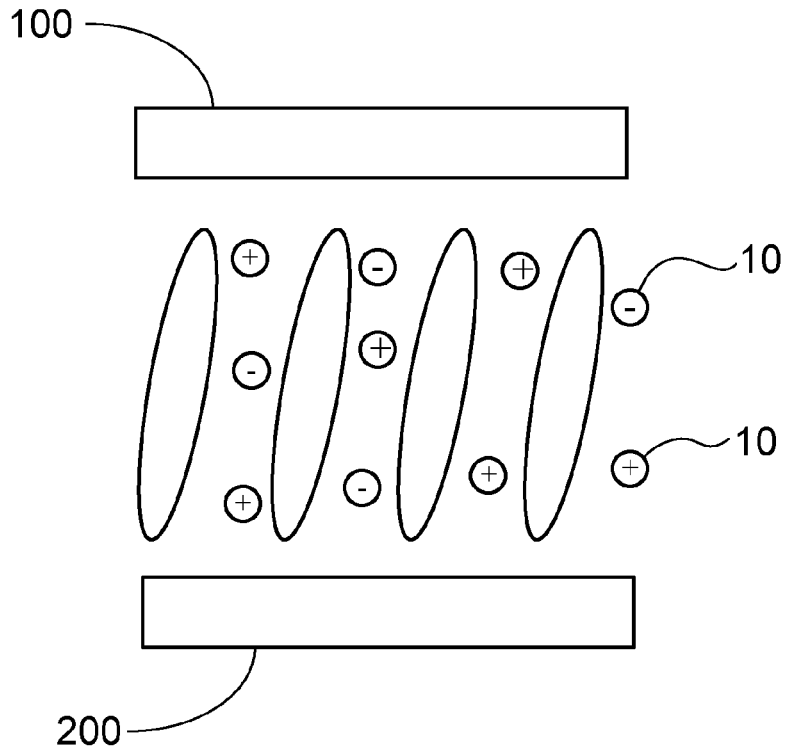
FIG.1 (prior art)
FIG. 1 is a schematic cross-sectional view illustrating a conventional liquid crystal display.
Figure 2:
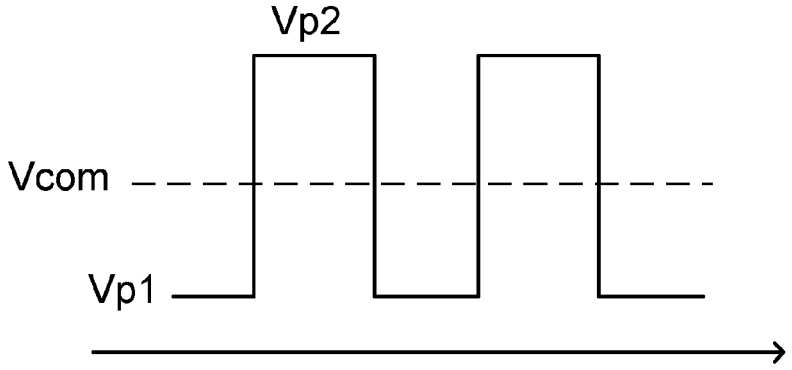
FIG. 2(prior art)
FIG. 2 is a schematic drawing illustrating a waveform of conventional AC driving voltages.
Figure 3:
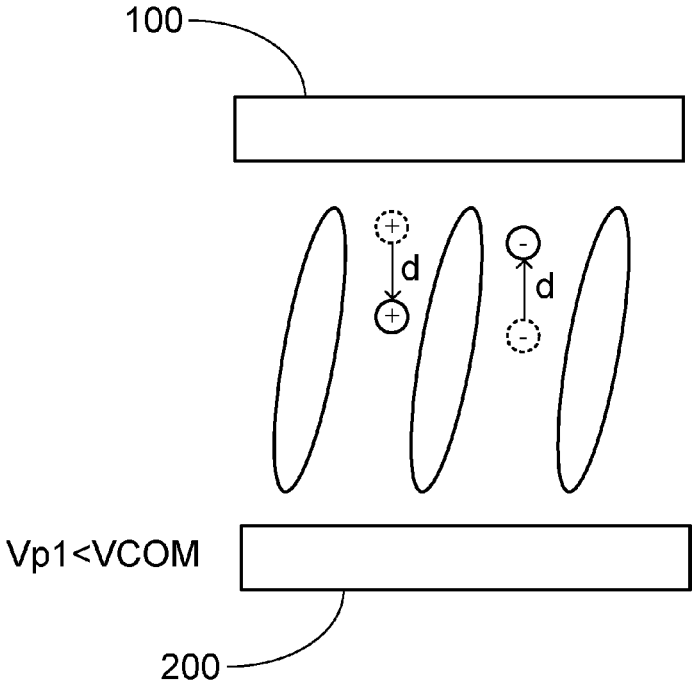
FIG.3 (prior art)
FIG. 3 is a schematic drawing illustrating the impurity ions moving when adding Vp1.
Figure 4:
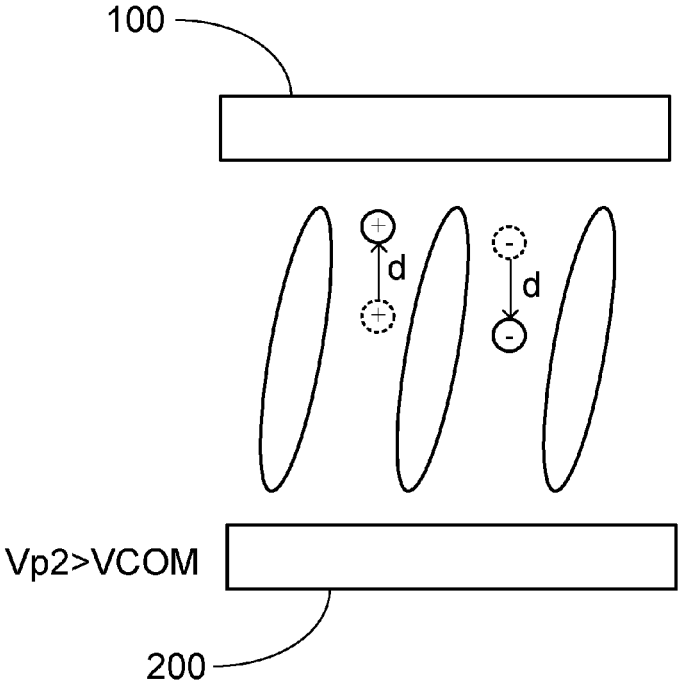
FIG. 4 (prior art)
FIG. 4 is a schematic drawing illustrating the impurity ions moving when adding Vp2.
Figure 5:
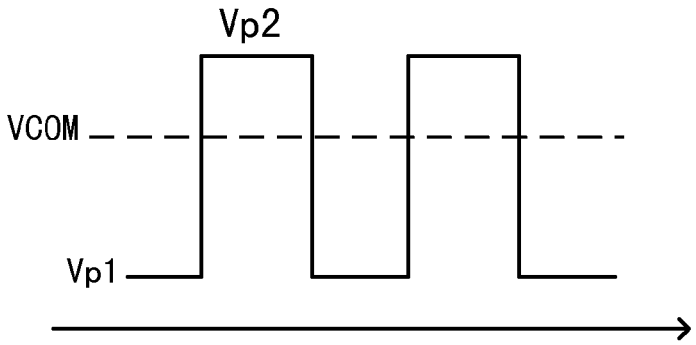
FIG.5 (prior art)
FIG. 5 is a schematic drawing illustrating a waveform of the driving voltages with two different voltage differences.
Figure 6:
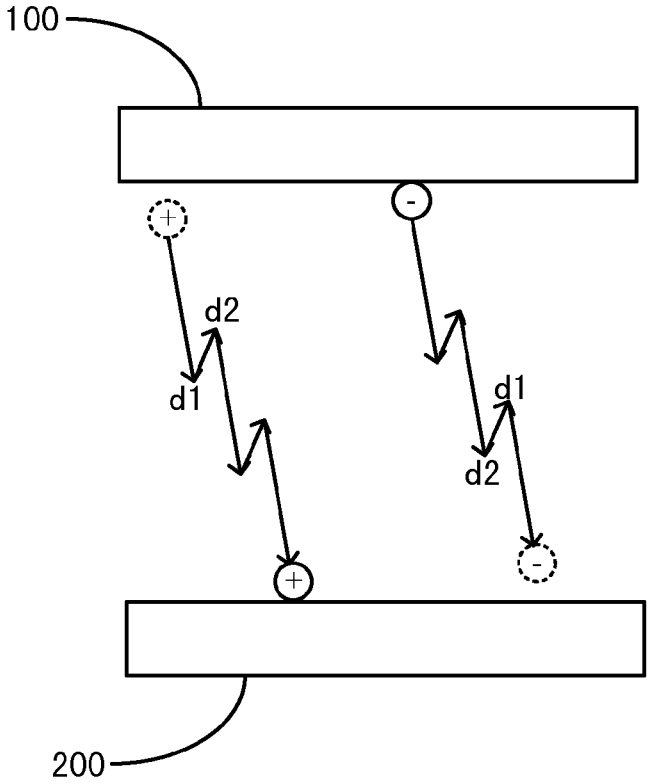
FIG. 6 (prior art)
FIG. 6 is a schematic drawing illustrating the impurity ions moving when adding the voltages shown in FIG. 5.
Figure 7:
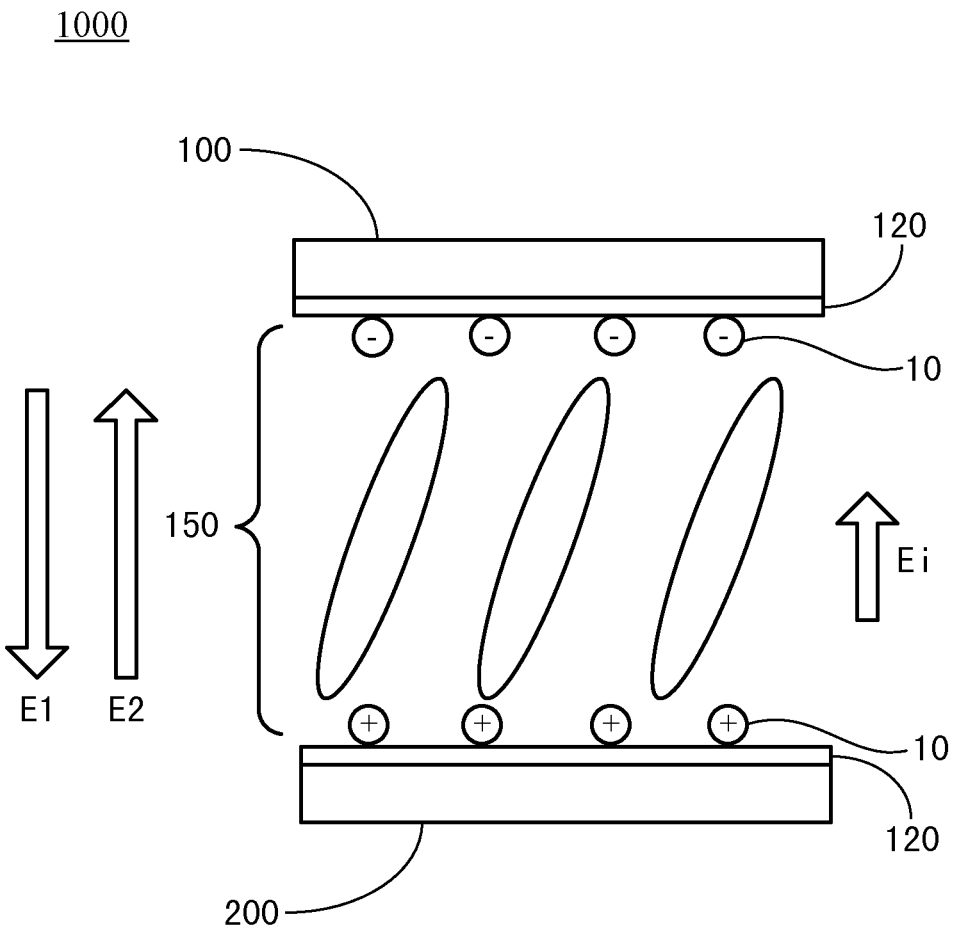
FIG. 7 is a schematic drawing illustrating an LCD according to a first preferred embodiment of the present invention.
Figure 8:
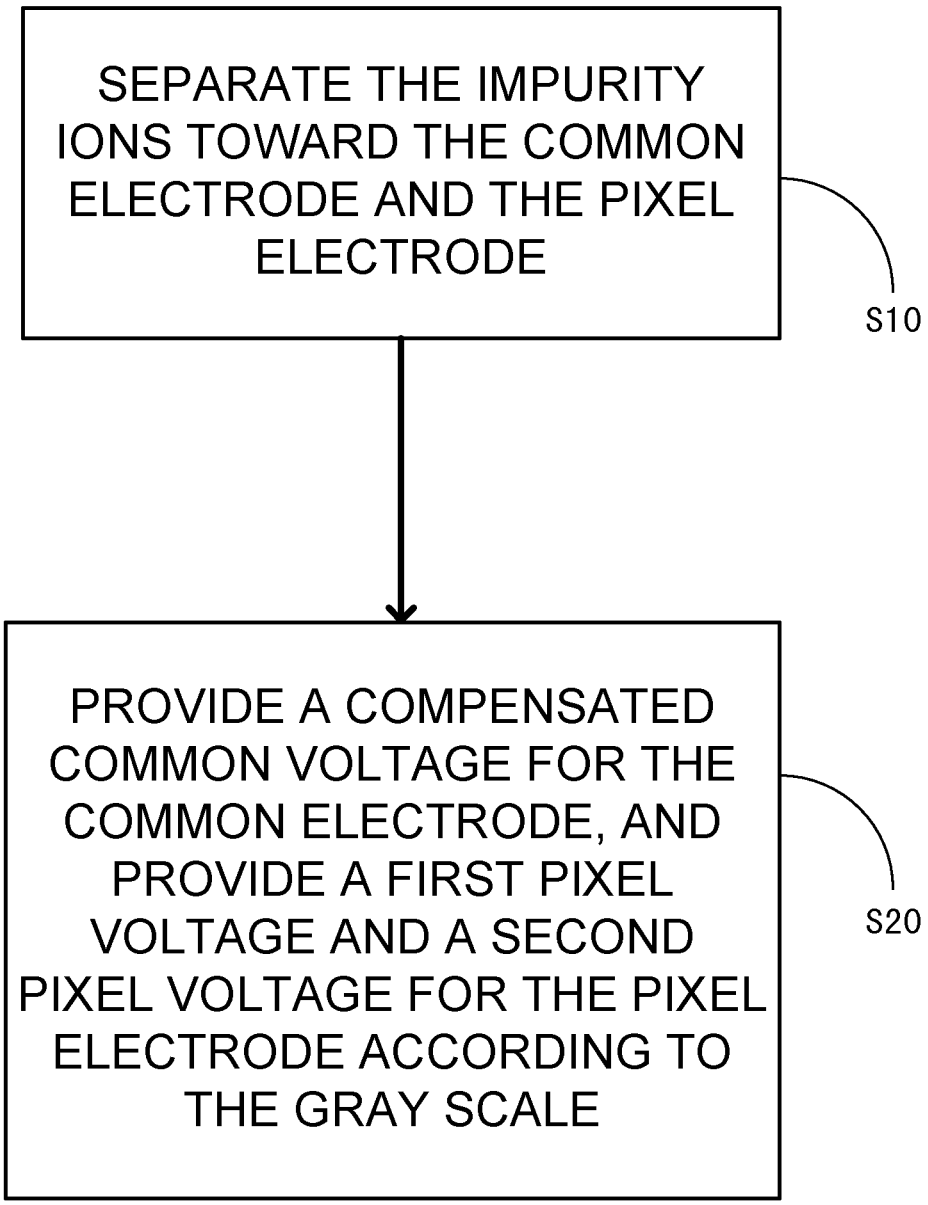
FIG. 8 is a flow chart illustrating a method for driving the LCD according to the present invention.

Referring to FIGS. 7 and 8, FIG. 7 is a schematic drawing illustrating an LCD according to a first preferred embodiment of the present invention; FIG. 8 is a flow chart illustrating a method for driving the LCD according to the present invention. The liquid crystal display includes a plurality of pixels 1000, a plurality of common electrodes 100, a plurality of pixel electrodes 200, and a liquid crystal layer 150. In order to explain clearly, FIG. 7 only depicts a single pixel 1000, a single common electrode 100 and a single pixel electrode 200. There are alignment films 120 on surfaces of the common electrode 100 and the pixel electrode 200 which face the liquid crystal layer 150. The liquid crystal layer 150 is located between the common electrode 100 and the pixel electrode 200, and the liquid crystal layer 150 has a plurality of impurity ions 10. The pixel 1000 is used to display a gray scale.

As shown in FIG. 8, the driving method includes steps S10 and S20.

Figure 9:
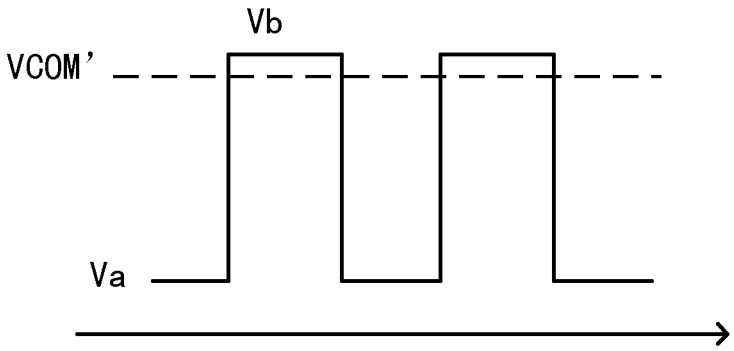
FIG. 9 is a schematic drawing illustrating a waveform of driving voltages according to the first preferred embodiment.

At step S10, the impurity ions 10 are separated toward the common electrode 100 and the pixel electrode 200 to form an internal electric field Vi in the liquid crystal layer 150. Referring to FIG. 9, FIG. 9 is a schematic drawing illustrating a waveform of driving voltages according to the first preferred embodiment. In the first preferred embodiment, the step which is to separate the impurity ions 10 is done by providing an offset common voltage VCOM' at the common electrode 100, and providing a first voltage Va and a second voltage Vb at the pixel electrode 200, so that a difference between the first voltage Va and the offset common voltage VCOM' is unequal to a difference between the second voltage Vb and the offset common voltage VCOM'. Specifically, the second voltage Vb is larger than the first voltage Va, and the offset common voltage VCOM' is between the first voltage Va and the second voltage Vb. Specifically, the aforementioned voltages can be adjusted by a conventional gate driver and a source driver accompanied with resistors or a digital-to-analog converter (DAC) integrated circuit, but the present invention is not limited to be implemented in the aforementioned way.

In the first preferred embodiment, the difference between the offset common voltage VCOM' and the first voltage Va is larger than the difference between the offset common voltage VCOM' and the second voltage Vb. That is to say, the offset common voltage VCOM' is close to the second voltage Vb, which enables the positive or negative impurity ions 10 to be gradually gathered to the alignment film 120 on the common electrode 100 and the pixel electrode 200, as shown in FIG. 7. Because the offset common voltage VCOM' is very close to the second voltage Vb, the positive impurity ions 10 are gathered to the pixel electrode 200, and the negative impurity ions 10 are gathered to the common electrode 100. The impurity ions 10 establish an internal electric field Ei which gradually reach a maximum during the process of being gathered, that is, the charge residuals are formed. Thus, the internal electric field Ei becomes a constant. A direction of the internal electric field Ei is toward the common electrode 100 from the pixel electrode 200. It is worth mentioning that the internal electric field Ei multiplied by a thickness D of the liquid crystal layer 150 is an internal voltage Vi, which is established by the internal electric field Ei between the both ends of the common electrode 100 and the pixel electrode 200. Similarly, the internal voltage Vi also becomes a constant.

Figure 10:
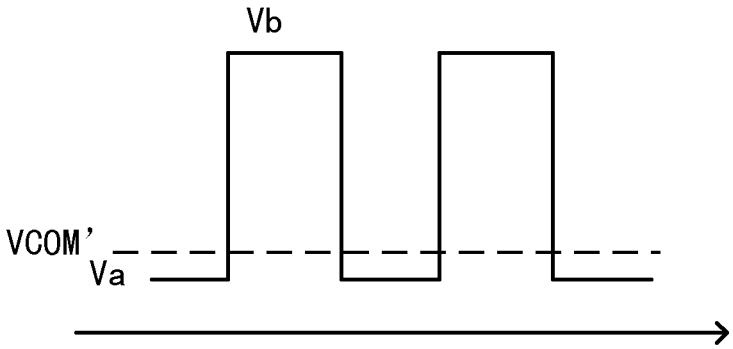
FIG. 10 is a schematic drawing illustrating a waveform of driving voltages according to the second preferred embodiment.
Figure 11:
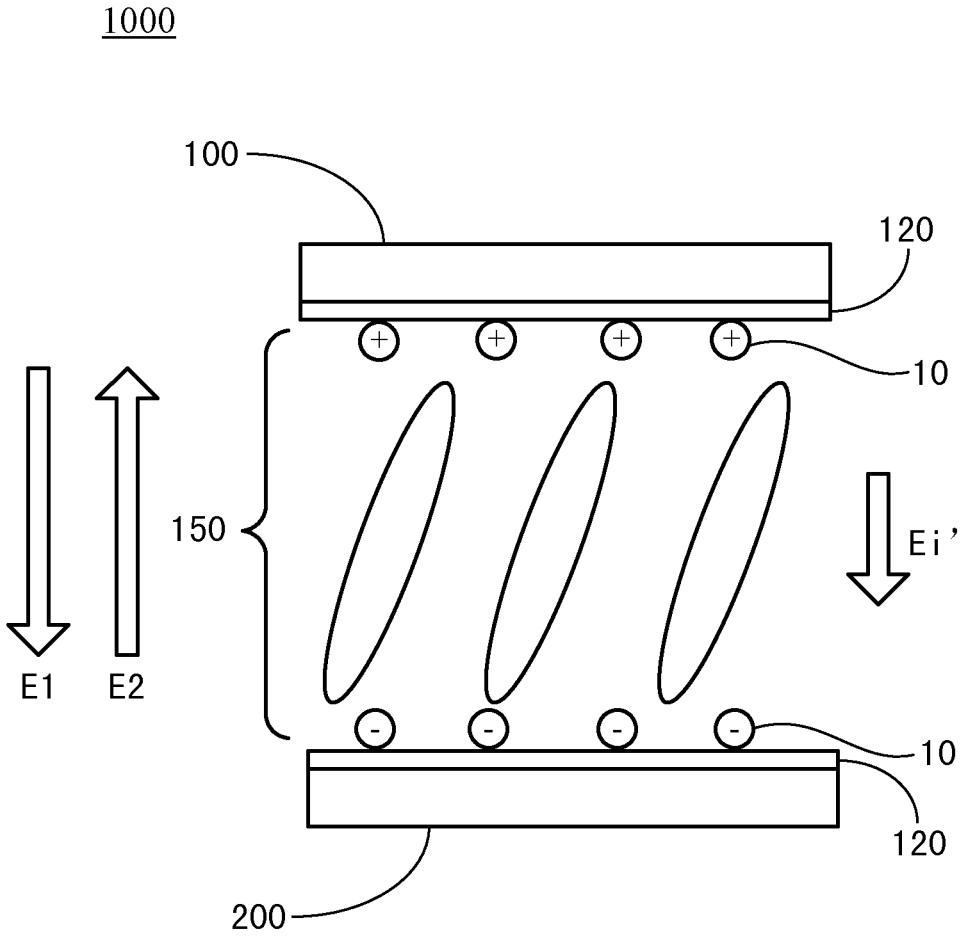
FIG. 11 is a schematic drawing illustrating an LCD according to a second preferred embodiment.

Referring to FIGS. 10 and 11, FIG. 10 is a schematic drawing illustrating a waveform of driving voltages according to the second preferred embodiment; and FIG. 11 is a schematic drawing illustrating an LCD according to a second preferred embodiment. Similarly, in the second preferred embodiment, the difference between the offset common voltage VCOM' and the first voltage Va is less than the difference between the offset common voltage VCOM' and the second voltage Vb. That is to say, the offset common voltage VCOM' is close to the first voltage Va, which enables the positive or negative impurity ions 10 gradually be gathered to the alignment film 120 on the common electrode 100 and the pixel electrode 200, as shown in FIG. 11. Because the offset common voltage VCOM' is very close to the first voltage Va, the positive impurity ions 10 are gathered to the common electrode 100, and the negative impurity ions 10 are gathered to the pixel electrode 200. The impurity ions 10 establish an internal electric field Ei which gradually reach a maximum during the process of being gathered, that is, the charge residuals are formed. Thus, the internal electric field Ei becomes a constant. The direction of the internal electric field Ei is toward the pixel electrode 200 from the common electrode 100. It is worth mentioning that the internal electric field Ei multiplied by a thickness D of the liquid crystal layer 150 is an internal voltage Vi, which is established by the internal electric field Ei between the both ends of the common electrode 100 and the pixel electrode 200. Similarly, the internal voltage Vi also becomes a constant.

At step S20, according to the gray scale, a common voltage VCOM is provided for the common electrode 100, and a first compensation voltage Vc1 and a second compensation voltage Vc2 are provided for the pixel electrode 200. The first compensation voltage Vc1 and the second compensation voltage are Vc2 are utilized to compensate the internal electric field Ei, so that a difference between the first compensation voltage Vc1 and the common voltage VCOM is equal to a difference between the second compensation voltage Vc2 and the common voltage VCOM.

Figure 12:
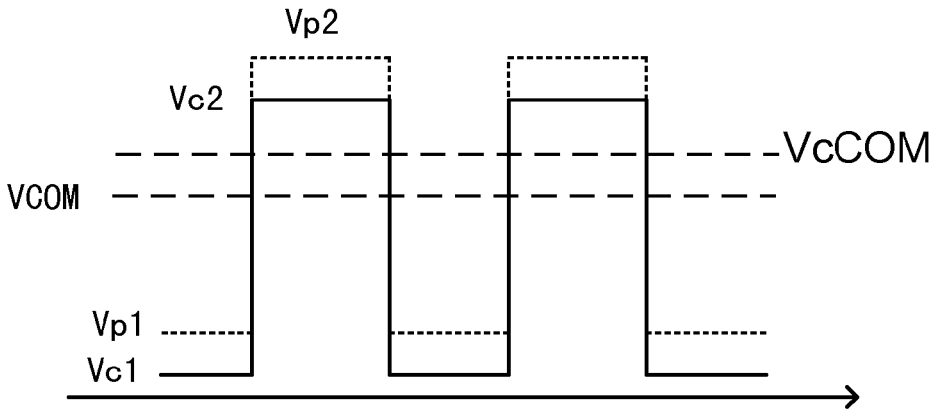
FIG. 12 is a schematic drawing illustrating a waveform of the first compensation voltage and the second compensation voltage according to the first preferred embodiment.

Referring to FIG. 12, FIG. 12 is a schematic drawing illustrating a waveform of the first compensation voltage Vc1 and the second compensation voltage Vc2 according to the first preferred embodiment. In the first preferred embodiment, the pixel voltages for the pixel 1000 to display the gray scale are first pixel voltage Vp1 and the second pixel voltage Vp2, and the difference between Vp1 and the common voltage VCOM is equal to the difference between Vp2 the common voltage VCOM. Referring to FIG. 7 again, when the first pixel voltage Vp1 is provided for the pixel 1000, the direction of the formed external voltage E1 is opposite to the direction of the internal electric field Ei. Thus, the actual first pixel voltage Vp1 is close to the common voltage VCOM. When the second pixel voltage Vp2 is provided for the pixel 1000, the direction of the formed external voltage E2 is the same as the direction of the internal electric field Ei. Thus, the actual second pixel voltage Vp2 is far from the common voltage VCOM. Therefore, in order to compensate the internal voltage Vi, the first compensation voltage Vc1 is the first pixel voltage Vp1 minus a voltage value of the internal electric field Ei (i.e. Vp1−Vi), and the second compensation voltage Vc2 is a second pixel voltage Vp2 minus the voltage value of the internal electric field Ei (i.e. Vp2−Vi).

Figure 13:
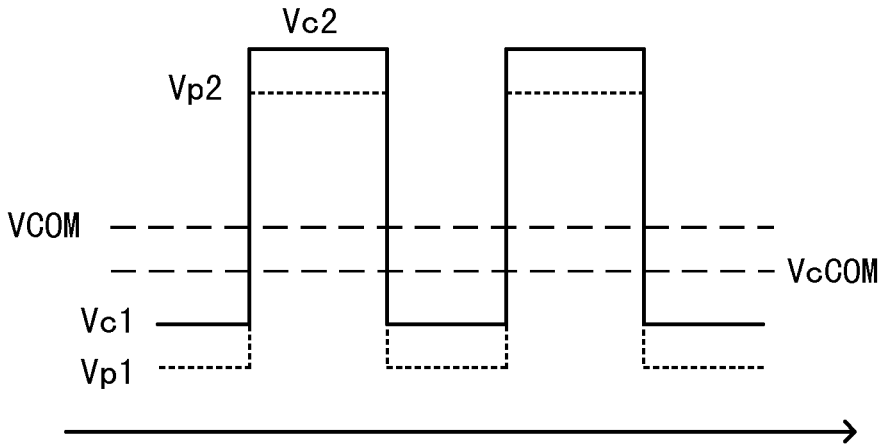
FIG. 13 is a schematic drawing illustrating a waveform of the first compensation voltage and the second compensation voltage according to the second preferred embodiment.

Referring to FIG. 13, FIG. 13 is a schematic drawing illustrating a waveform of the second compensation voltage Vc1 and the second compensation voltage Vc2 according to the first preferred embodiment. Similarly, in the second preferred embodiment, the direction of the internal electric field Ei' is opposite to the direction of the internal electric field Ei of the first embodiment. Referring to FIG. 11 again, When the first pixel voltage Vp1 is provided for the pixel 1000, the direction of the formed external voltage E1 is the same as the direction of the internal electric field Ei'. Thus, the actual first pixel voltage Vp1 is far from the common voltage VCOM. When the second pixel voltage Vp2 is provided for the pixel 1000, the direction of the formed external voltage E2 is opposite to the direction of the internal electric field Ei. Thus, the actual second pixel voltage Vp2 is close to the common voltage VCOM. Therefore, in order to compensate the internal voltage Vi, the first compensation voltage Vc1 is the first pixel voltage Vp1 plus a voltage value of the internal electric field Ei (i.e. Vp1+Vi), and the second compensation voltage Vc2 is a second pixel voltage Vp2 plus the voltage value of the internal electric field Ei (i.e. Vp2+Vi).

Except for the above-mentioned ways of adjustment, the common voltage VCOM can be adjusted so as to make the difference between the actual first pixel voltage and the common voltage VCOM is equal to the difference between the actual second pixel voltage and the common voltage VCOM. That is, at the above-mentioned step S20, the step is modified as that a compensated common voltage VcCOM is provided for the common electrode 100, and the first pixel voltage Vp1 and the second pixel voltage Vp2 are provided for the pixel electrode according to the gray scale. The compensated common voltage VcCOM is utilized to compensate the internal electric field so that a difference between the first pixel voltage Vp1 and the compensated common voltage VcCOM is equal to a difference between the second pixel voltage Vp2 and the compensated common voltage VcCOM. Referring to FIG. 12 again, in the first preferred embodiment, the compensated common voltage VcCOM is the common voltage VCOM plus the internal voltage Vi. Referring to FIG. 13 again, in the second preferred embodiment, the compensated common voltage VcCOM is the common voltage VCOM minus the internal voltage Vi. However, the present invention is not limited to be implemented in the two above-mentioned adjusting ways. The first pixel voltage Vp1, the second pixel voltage Vp and the common voltage VCOM can be adjusted simultaneously.

It is worth mentioning that the above-mentioned first compensation voltage Vc1, the second compensation voltage Vc2 and the compensated common voltage VcCOM can be adjusted by a conventional gate driver and a source driver accompanied with resistors or a digital-to-analog converter (DAC) integrated circuit, but the present invention is not limited to be implemented in the aforementioned way.

In summary, the present invention solves the above-mentioned issue by a reversed notion. The charge accumulation is intentionally formed, and then the first pixel voltage Vp1 and the second pixel voltage Vp2 are adjusted as the first compensation voltage Vc1 and the second compensation voltage Vc2, thereby correctly displaying the images. Accordingly, the impact of the charge residuals on the images is eliminated on one hand, and on the other hand, even if there are some deviations on the voltage differences between the common electrode VCOM and the pixel electrode 200, there will be no the impact caused by the accumulation of the moving impurity ions, resulting in the abnormal image display.

While the preferred embodiments of the present invention have been illustrated and described in detail, various modifications and alterations can be made by persons skilled in this art. The embodiment of the present invention is therefore described in an illustrative but not restrictive sense. It is intended that the present invention should not be limited to the particular forms as illustrated, and that all modifications and alterations which maintain the spirit and realm of the present invention are within the scope as defined in the appended claims.

What is claimed is:

1. A method for driving a liquid crystal display (LCD), the LCD comprising a common electrode, a pixel electrode, a liquid crystal layer located between the common electrode and the pixel electrode, the liquid crystal layer having a plurality of impurity ions and a pixel utilized for displaying a gray scale, characterized in that the method comprises steps of:

separating the impurity ions toward the common electrode and the pixel electrode to form an internal electric field in the liquid crystal layer; and providing a compensated common voltage for the common electrode, and providing a first pixel voltage and a second pixel voltage for the pixel electrode according to the gray scale, wherein the compensated common voltage is utilized to compensate the internal electric field so that a difference between the first pixel voltage and the compensated common voltage is equal to a difference between the second pixel voltage and the compensated common voltage;

wherein the step of separating the impurity ions is done by providing an offset common voltage at the common electrode, and providing a first voltage and a second voltage at the pixel electrode so that a difference between the first voltage and the offset common voltage is unequal to a difference between the second voltage and the offset common voltage.

2. The method for driving the LCD according to claim 1, characterized in that the step of separating the impurity ions is done by providing an offset common voltage at the common electrode, and providing a first voltage and a second voltage at the pixel electrode so that a difference between the first voltage and the offset common voltage is unequal to a difference between the second voltage relative to the offset common voltage.

3. The method for driving the LCD according to claim 2, characterized in that the second voltage is larger than the first voltage, and the offset common voltage is between the first voltage and the second voltage, and the difference between the offset common voltage and the first voltage is larger than the difference between the offset common voltage and the second voltage, and then the compensated common voltage is a common voltage plus the internal voltage.

4. The method for driving the LCD according to claim 2, characterized in that the second voltage is larger than the first voltage, and the offset common voltage is between the first voltage and the second voltage, and the difference between the offset common voltage and the first voltage is less than the difference between the offset common voltage and the second voltage, and then the compensated common voltage is a common voltage minus the internal voltage.

5. The method for driving the LCD according to claim 2, characterized in that the compensated common voltage is adjusted by using resistors or a digital-to-analog converter integrated circuit.

6. A method for driving a liquid crystal display (LCD), the LCD comprising a common electrode, a pixel electrode, a liquid crystal layer located between the common electrode and the pixel electrode, the liquid crystal layer having a plurality of impurity ions and a pixel utilized for displaying a gray scale, characterized in that the method comprises steps of:

separating the impurity ions toward the common electrode and the pixel electrode to form an internal electric field in the liquid crystal layer; and providing a common voltage for the common electrode, and providing a first compensation voltage and a second compensation voltage for the pixel electrode according to the gray scale, wherein the first compensation voltage and the second compensation voltage are utilized to compensate the internal electric field so that a difference between the first compensation voltage and the common voltage is equal to a difference between the second compensation voltage and the common voltage;

wherein the step of separating the impurity ions is done by providing an offset common voltage at the common electrode, and providing a first voltage and a second voltage at the pixel electrode so that a difference between the first voltage and the offset common voltage is unequal to a difference between the second voltage and the offset common voltage.

7. The method for driving the LCD according to claim 6, characterized in that the second voltage is larger than the first voltage, and the offset common voltage is between the first voltage and the second voltage.

8. The method for driving the LCD according to claim 7, characterized in that the difference between the offset common voltage and the first voltage is larger than the difference between the offset common voltage and the second voltage.

9. The method for driving the LCD according to claim 8, characterized in that a direction of the internal electric field is toward the common electrode from the pixel electrode.

10. The method for driving the LCD according to claim 9, characterized in that the first compensation voltage is a first pixel voltage minus a voltage value of the internal electric field, and the second compensation voltage is a second pixel voltage minus the voltage value of the internal electric field.

11. The method for driving the LCD according to claim 7, characterized in that the difference between the offset common voltage and the first voltage is less than the difference between the offset common voltage and the second voltage.

12. The method for driving the LCD according to claim 11, characterized in that a direction of the internal electric field is toward the pixel electrode from the common electrode.

13. The method for driving the LCD according to claim 12, characterized in that the first compensation voltage is a first pixel voltage plus a voltage value of the internal electric field, and the second compensation voltage is a second pixel voltage plus the voltage value of the internal electric field.

14. The method for driving the LCD according to claim 6, characterized in that the first compensation voltage and second compensation voltage are adjusted by using resistors or a digital-to-analog converter integrated circuit.

* * * * *